US007197984B2

(12) United States Patent
Eches

(10) Patent No.: US 7,197,984 B2
(45) Date of Patent: Apr. 3, 2007

(54) SUB-CALIBER PROJECTILE, PENETRATOR AND SABOT ENABLING SUCH A PROJECTILE

(75) Inventor: Nicolas Eches, Plaimpied-Givaudins (FR)

(73) Assignee: Giat Industries, Versailles (FR)

( * ) Notice: Subject to any disclaimer, the term of this patent is extended or adjusted under 35 U.S.C. 154(b) by 262 days.

(21) Appl. No.: 10/838,209

(22) Filed: May 5, 2004

(65) Prior Publication Data

US 2005/0011397 A1 Jan. 20, 2005

(30) Foreign Application Priority Data

May 9, 2003 (FR) ..... 03 05659

(51) Int. Cl.
*F42B 14/06* (2006.01)

(52) U.S. Cl. ..... 102/521

(58) Field of Classification Search ..... 102/521, 102/520, 522, 523
See application file for complete search history.

(56) References Cited

U.S. PATENT DOCUMENTS 1,475,578 A * 11/1923 Hadfield et al. ..... 102/526
3,262,391 A * 7/1966 Shober ..... 102/521
3,859,922 A 1/1975 Kaplan et al.
4,360,954 A * 11/1982 Burns et al. ..... 86/52
4,724,770 A 2/1988 Fuchs et al.
5,063,855 A * 11/1991 Diel et al. ..... 102/521
5,133,262 A * 7/1992 Schaake et al. ..... 102/521
5,204,494 A * 4/1993 Meyer et al. ..... 102/521
5,639,985 A * 6/1997 Garner et al. ..... 102/521
5,723,810 A * 3/1998 Sauvestre ..... 102/439

FOREIGN PATENT DOCUMENTS

DE 39 05 907 A1 9/1990
FR 2666647 3/1992

* cited by examiner

*Primary Examiner*—Michael J. Carone
*Assistant Examiner*—James S. Bergin
(74) *Attorney, Agent, or Firm*—Oliff & Berridge, PLC

(57) ABSTRACT

A sub-caliber projectile incorporating a penetrator and a sabot formed of several segments, the penetrator and sabot incorporating profiles that cooperate with one another so as to ensure the axial drive of the penetrator by the sabot when the projectile is being fired, such projectile wherein there is axial play (J) between the profile on the sabot and that on the penetrator so as to enable a limited relative axial displacement of the sabot with respect to the penetrator, means being provided to ensure the radial locking of the sabot segments by the penetrator in the foremost position of the sabot with respect to the penetrator, this locking no longer being ensured in the rearmost position of the sabot with respect to the penetrator.

13 Claims, 5 Drawing Sheets

SUB-CALIBER PROJECTILE, PENETRATOR AND SABOT ENABLING SUCH A PROJECTILE

BACKGROUND OF THE INVENTION

The technical scope of the invention is that of projectiles incorporating a sub-calibre penetrator positioned in a full calibre sabot.

The sabot is made of a light material, for example aluminum, and is classically formed of several segments (more often than not, three) which surround the penetrator. The segments are linked together by a band that ensure gas tightness within the gun barrel and one or two retention rings, located to the fore or rear of the sabot, or on a front guiding seat.

The sabot enables the penetrator to be fired from the gun barrel. It releases the penetrator upon exiting the barrel.

The penetrator and the sabot generally incorporate profiles cooperating with each other so as to ensure the axial drive of the penetrator by the sabot when the projectile is being fired. These profiles may comprise helicoidal threading on the penetrator housed in female threading in the sabot or else a succession of teeth and ring-shaped grooves.

Patent FR2666647 describes such a known projectile.

Classical drive profiles are designed so as to supply the sabot with a bearing surface enabling it to transmit the longitudinal thrusting stresses, created by the action of the powder gases, to the penetrator. This profile is thus essentially dimensioned to withstand shearing.

Classical profiles are either so-called ISO profiles (in which the teeth are trapezoidal and symmetrical with respect to the transversal plane) or artillery profiles (in which the teeth are not symmetrical but have a rear flank strongly inclined with respect to the penetrator's axis).

When a projectile incorporating a drive profile of a known type moves through the barrel of a weapon, it is subjected to a certain number of transversal disturbances caused by the curvature of the barrel, pressure dissymmetry and the projectile's own vibrations which cause flexions in the penetrator.

The three sabot segments thus work independently of each other and at any given moment there are only one or two segments supporting the penetrator in flexion. The sabot, therefore, does not help the penetrator to withstand flexion.

These segment movements are all the greater in that the penetrator is long (L/D elongation over 25).

Moreover, through the combined action of its inertia, the pressure stresses and traversal accelerations, the sabot can start to open at its front pocket. In this case, the support it gives to the penetrator is reduced.

Deficiencies in the support of the penetrator lead to firing obliquities and a loss of accuracy.

Furthermore, when the front of the sabot opens like this, the guiding seats create greater friction with the barrel, thus aggravating its wear.

SUMMARY OF THE INVENTION

The aim of the invention is to propose a projectile allowing such drawbacks to be overcome. The invention also relates to the penetrator and sabot constituting such a projectile.

Thus, the projectile according to the invention incorporates means at the drive interface of the penetrator and the sabot, which also provide radial retention for the sabot segments.

This results in better flexion-resistance of the sabot and improved retention of the penetrator, and thus leads to an enhancement of firing accuracy. This increase in transversal rigidity also enables the sabot's mass to be reduced.

The invention thus relates to a sub-calibre projectile incorporating a penetrator and a sabot formed of several segments, the penetrator and sabot incorporating profiles that cooperate with one another so as to ensure the axial drive of the penetrator by the sabot when the projectile is being fired, such projectile wherein there is axial play between the profile on the sabot and that on the penetrator so as to enable a limited relative axial displacement of the sabot with respect to the penetrator, means being provided to ensure the radial locking of the sabot segments by the penetrator in the foremost position of the sabot with respect to the penetrator, this locking no longer being ensured in the most rearward position of the sabot with respect to the penetrator.

According to one embodiment of the invention, the profiles on the sabot and on the penetrator are formed of teeth and grooves, the teeth and grooves being ring-shaped or formed by helicoidal threading, a rear face of the teeth on the penetrator having a concave conical profile cooperating during firing with a convex conical profile made on a front face of the teeth on the sabot, these profiles constituting means to ensure the radial locking of the sabot segments with respect to the penetrator during firing.

According to one embodiment, a front face of the teeth on the penetrator has a convex conical profile arranged during firing at a distance from a concave conical profile made on a rear face of the teeth on the sabot, these profiles being additionally in contact with one another upon exiting the gun barrel when the sabot recoils with respect to the penetrator, the contact between these profiles enabling the sabot segments to be kept away from the penetrator.

According to another embodiment, a front face of the teeth on the penetrator has a concave profile arranged during firing at a distance from a convex profile made on a rear face of the teeth on the sabot, these profiles coming into contact with each other upon exiting the gun barrel when the sabot recoils with respect to the penetrator, the shape of the profiles being chosen so as to keep the sabot segments away from the penetrator with a starting movement of the segments that is substantially parallel to the penetrator.

According to another embodiment, the locking means comprise a specific tooth located to the fore of the grooves or threading on the penetrator, such tooth incorporating a concave conical profile on its rear face cooperating during firing with a convex conical profile made on a front face of a tooth on the sabot so as to ensure the radial locking of the sabot segments with respect to the penetrator during firing.

The invention also relates to a sub-calibre penetrator intended to be incorporated into a projectile, wherein it incorporates an external profile incorporating teeth separated by grooves, teeth and grooves being ring-shaped or formed by helicoidal threading, a rear face of the teeth having a concave conical profile.

A front face of the penetrator's teeth may have a convex conical profile.

Alternatively, a front face of the penetrator's teeth may have a concave profile.

The penetrator may incorporate an external profile incorporating teeth separated by grooves, teeth and grooves being ring-shaped or formed by helicoidal threading, one specific tooth being positioned to the fore of the teeth or grooves of the penetrator, such tooth incorporating a concave conical profile at its rear face.

The invention also relates to a sabot intended to be incorporated into a projectile, such sabot wherein it incorporates an internal profile intended to accommodate a penetrator and incorporating teeth separated by grooves, teeth and grooves being ring-shaped or formed by helicoidal threading, one front face of the teeth having a convex conical profile.

A rear face of the sabot teeth may have a concave conical profile.

Alternatively, a rear face of the sabot teeth may have a convex profile.

The sabot may incorporate an internal profile intended to accommodate the penetrator incorporating teeth separated by grooves, teeth and grooves being ring-shaped or formed by helicoidal threading, the front face of the tooth positioned the foremost incorporating a convex conical profile.

BRIEF DESCRIPTION OF THE DRAWINGS

The invention will become more apparent from the following description of the different embodiments, such description being made in reference to the appended drawings, in which.

DETAILED DESCRIPTION OF PREFERRED EMBODIMENTS

Figure 1:
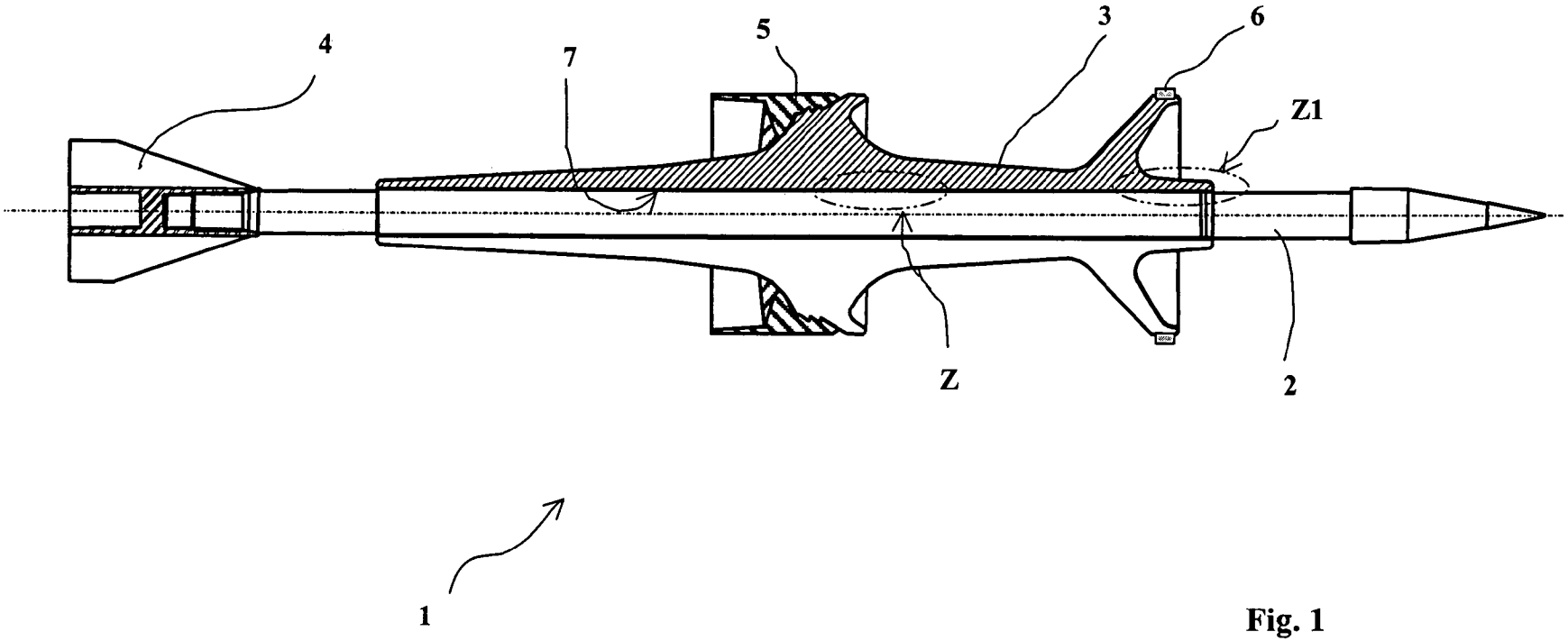
FIG. 1 shows a schematic longitudinal section of a sabot for a discarding-sabot projectile according to prior art or according to the invention.

With reference to FIG. 1, a projectile 1 according to the invention or according to prior art classically comprises a penetrator 2 and a sabot 3 formed of several segments.

The penetrator has a fin 4 at its rear part and the different sabot segments are made integral with each other by a band 5 and a front ring 6.

The penetrator 2 is housed in a bore 7 in the sabot 3. This bore incorporates a profile (not visible in FIG. 1) which cooperates with a profile of the external cylindrical surface of the penetrator 2 so as to ensure the axial drive of the penetrator by the sabot when the projectile is being fired. The oval zone marked Z in FIG. 1 is enlarged in FIGS. 2*a* to 4*c*, zone Z1 is furthermore enlarged in FIGS. 5*a* and 5*b*, these zones usefully highlighting the differences between the linking profiles for projectiles according to prior art and for projectiles according to the invention.

Figure 2A:
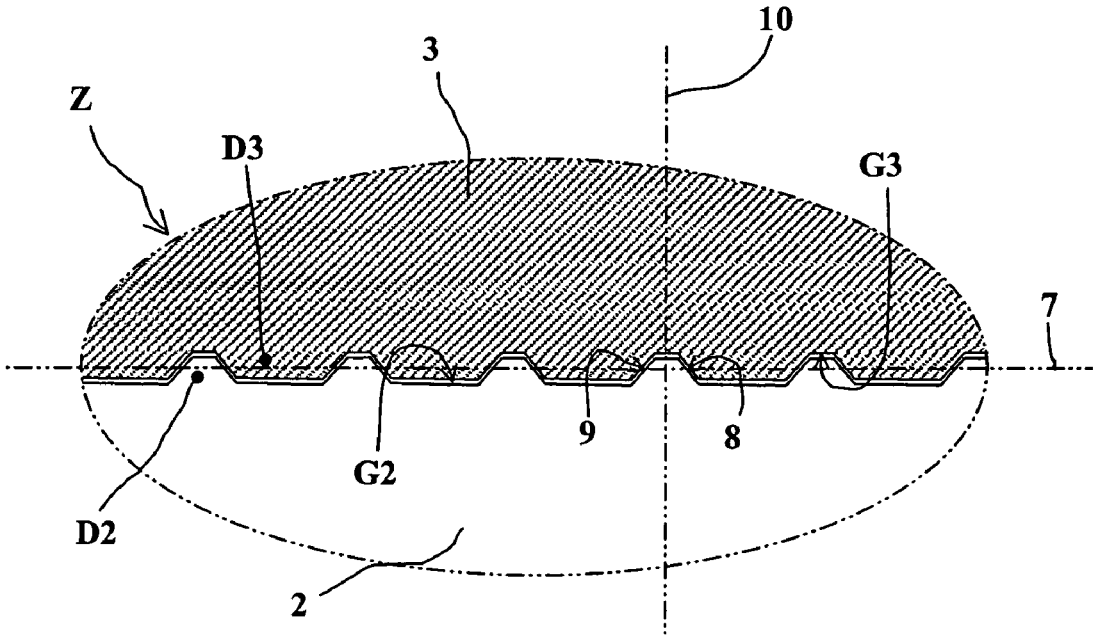
FIGS. 2*a* and 2*b* show an enlarged view of the linking profiles according to prior art, FIG. 2*a* showing an ISO profile and FIG. 2*b* an artillery profile.
Figure 2B:
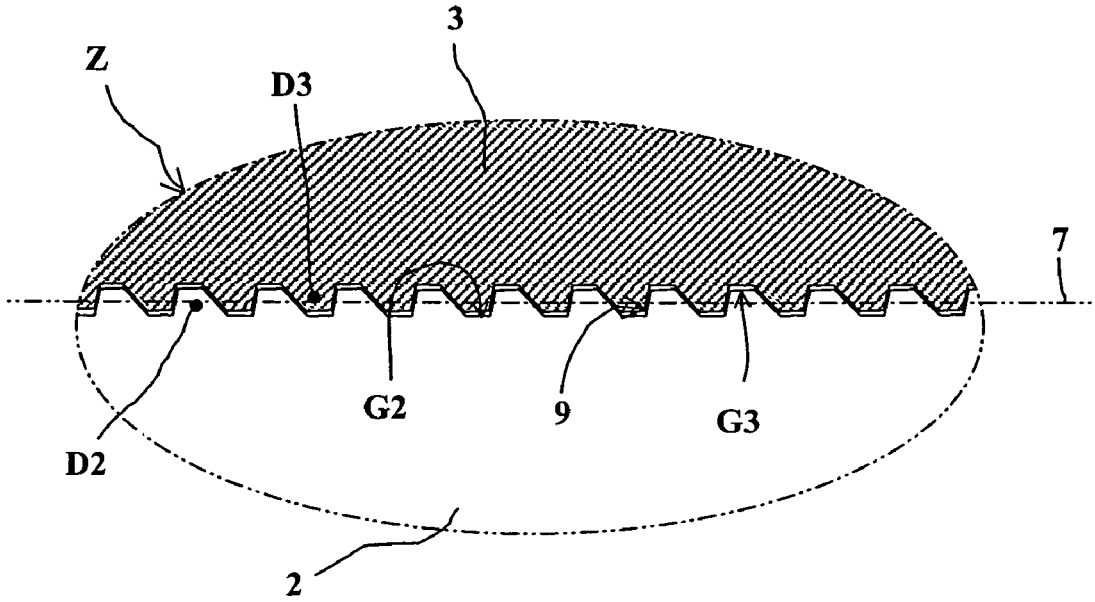

FIGS. 2*a* and 2*b* show an enlargement and longitudinal section of zone Z for the linking profiles according to prior art.

These profiles comprise a succession of teeth separated by grooves. The sabot teeth are marked D3 and the sabot grooves G3, the penetrator teeth are marked D2 and the penetrator grooves G2.

For the ISO profile shown in FIG. 2*a*, the teeth D2, D3 and the grooves G2 and G3 have a trapezoid-shaped section, all are symmetrical with respect to a plane 10 perpendicular to the penetrator's axis and passing through the tip of the tooth or groove under consideration.

Thus, the front 8 and rear 9 flanks of each tooth (or groove) form an equal angle with the direction of the bore 7.

FIG. 2*b* shows another known drive profile, the artillery profile. In this profile, the teeth and grooves are not symmetrical. In particular, the teeth D2 of the penetrator incorporate a rear flank 9 that is strongly inclined with respect to the direction of the bore 7.

Known profiles are either constituted by helicoidal threading on the penetrator cooperating with female threading on the sabot, or by a succession of ring-shaped teeth and grooves.

Figure 3A:
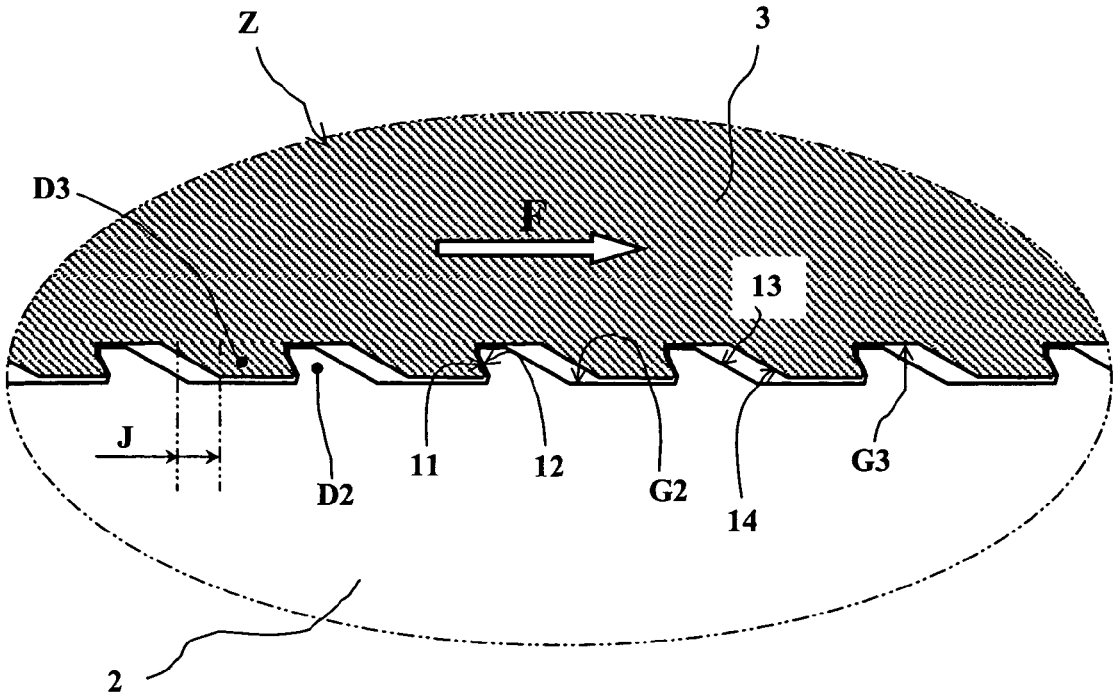
FIG. 3*a* shows an enlargement of a first embodiment of a drive profile implemented on a projectile according to the invention, this Figure shows how the sabot profile cooperates with that of the penetrator when the projectile is being fired.
Figure 3B:
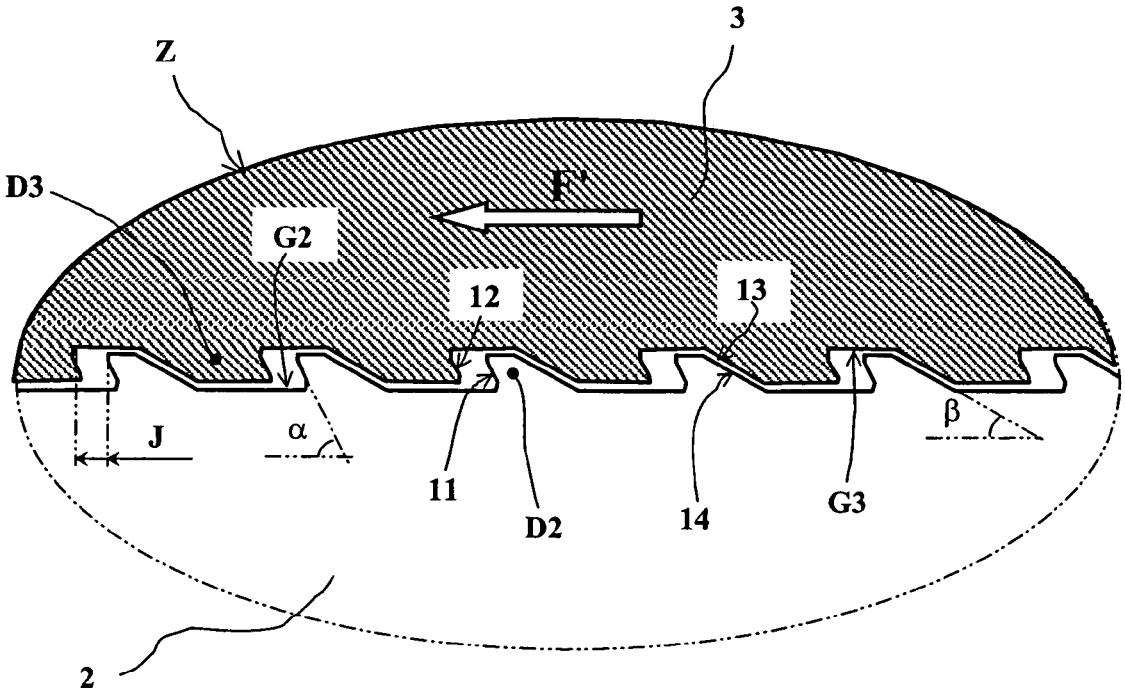
FIG. 3*b* shows how the sabot profile cooperates with that of the penetrator upon exiting the barrel.

FIGS. 3*a* and 3*b* show an enlargement of zone Z in FIG. 1 for a projectile according to a first embodiment of the invention.

According to this embodiment, each rear face 11 of the teeth D2 on the penetrator 2 has a concave conical profile which is defined so as to be able to cooperate during firing with a convex conical profile made on each front face 12 of the teeth D3 on the sabot 3.

This cooperation ensures the radial locking of the segments of the sabot 3 with respect to the penetrator 2 during firing.

Thus, the segments are no longer separated from the penetrator inside the barrel and thus provide support for it and reduce flexion.

Because of the orientation of the conical locking faces (11, 12), the retention of the sabot 3 segments is all the more rigid in that the propellant stress is high. Locking the sabot segments improves the cohesion of the projectile. The sabot assembly may thus work in flexion thereby making it possible to lighten the sabot. Indeed, the thicknesses of the sabot may be reduced since they were partially selected to improve flexion-resistance. This reduction in mass may be of around 5%.

The half angle at the tip $\alpha$ (FIG. 3*b*) of the conical surfaces of faces 11 and 12 will be selected at around 70° to 85°.

The longitudinal play J will be chosen taking into account the deviations in machining tolerances for the teeth (or threading) and thus taking into account the maximal thermal dilations.

This play enables a limited relative axial displacement of the sabot 3 with respect to the penetrator 2.

Such an arrangement is intended to allow the sabot and penetrator to separate upon exiting the gun barrel.

The projectile functions as follows.

During firing, the pressure exerted on the rear of the sabot drives it forwards. There is thus a relative displacement of the sabot with respect to the penetrator in direction F (see FIG. 3*a*). This displacement brings the conical profile of the front face 12 of teeth D3 of the sabot into contact with the matching profile of the rear face 11 of the penetrator's teeth.

The sabot 3 segments are thus radially locked around the penetrator 2. This locking is ensured for as long as the gas pressure acts on the rear of the sabot, that is to say, for all the time that the projectile is inside the gun barrel.

Upon exiting the gun barrel, the pressure exerted to the rear of the sabot suddenly drops. Moreover, the relative wind created by the displacement of the projectile through the air tends to oppose the displacement of the sabot. The sabot 3 thus moves backwards with respect to the penetrator 2 in direction F' (see FIG. 3*b*).

This displacement unlocks the sabot-penetrator link. The sabot 3 thus released is able to separate from the penetrator 2 according to classical opening mechanisms.

Each front face 13 of the teeth D2 on the penetrator 2 has a convex conical profile which comes into contact, when the sabot recoils, with a concave conical profile made on each rear face 14 of the teeth D3 on the sabot 3.

The cooperation of these conical profiles, in conjunction with the axial displacement, ensures a relative radial displacement of the sabot 3 segments with respect to the penetrator 2. To facilitate this separation, the half angle at the tip β (FIG. 3*b*) of the cones of faces 13 and 14 will be of around 45° to 60°.

The profiles will be easily machined using a tool having a shape which corresponds to the shape of the groove to be machined.

Figure 4A:
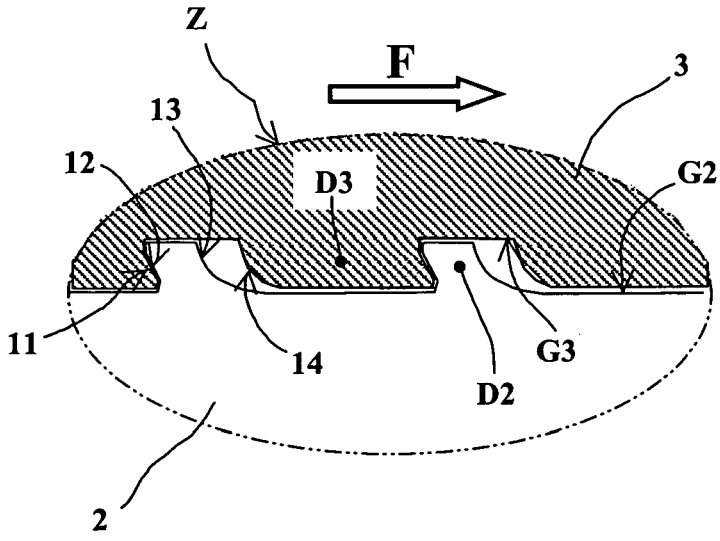
FIG. 4*a* shows an enlargement of a second embodiment of a drive profile implemented on a projectile according to the invention, this Figure shows how the sabot profile cooperates with that of the penetrator when the projectile is being fired.
Figure 4B:
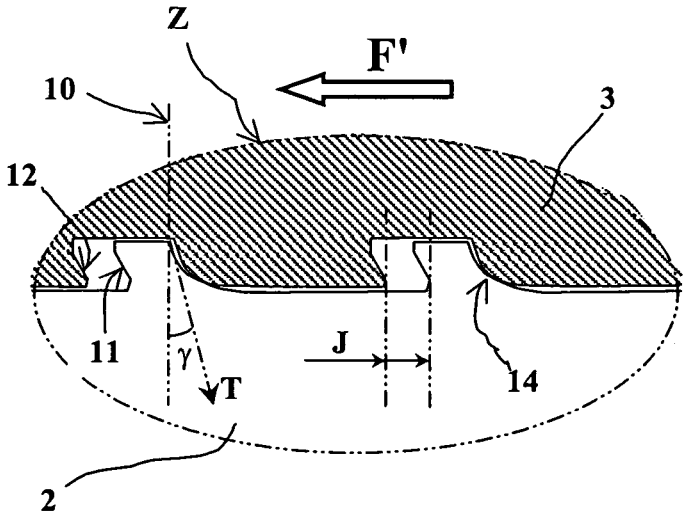
FIG. 4*b* shows a first stage in the cooperation of the sabot profile with that of the penetrator upon exiting the gun barrel.
Figure 4C:
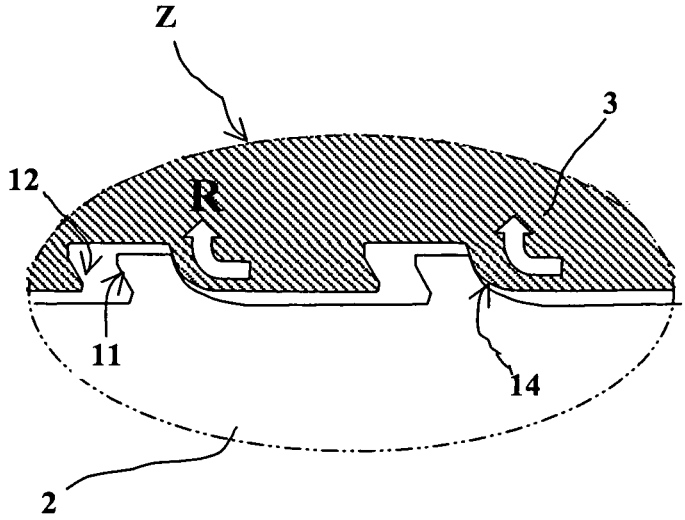
FIG. 4*c* shows a second stage in the cooperation of the sabot profile with that of the penetrator upon exiting the gun barrel.

FIGS. 4*a*, 4*b* and 4*c* show an enlargement of zone Z in FIG. 1 for a projectile according to a second embodiment of the invention.

Once again, teeth D2 and D3 on the penetrator or sabot have faces 11 and 12 that cooperate so as to radially lock the sabot segments with respect to the penetrator when the projectile is being fired (displacement of the sabot forwards with respect to the penetrator, in direction F shown in FIG. 4*a*).

In accordance with this particular embodiment, each front face 13 of teeth D2 on the penetrator 2 has a concave profile intended to cooperate upon exiting the gun barrel with a convex profile on each rear face 14 of teeth D3 on the sabot 3.

Moreover, these profiles are of a shape chosen so as to promote a radial distancing of the sabot segments during the sabot/penetrator separation process.

Such an arrangement promotes a sabot/penetrator separation with an initial movement of the segments that is substantially parallel to the penetrator. The risk of disturbance or shocks on the penetrator caused by the sabot when opening is thus minimized.

So as to promote thereby the radial displacement of the sabot segments, the profile of the front face 13 of teeth D2 will be defined such that the tangent T to this profile (FIG. 4*b*) is close to a radial direction to the penetrator 2 (angle γ of the tangent T with a radial plane 10 of around 5° to 10°).

Once again, the profiles will be easily machined using tooling of a shape matching the shape of the groove to be machined.

Figure 5A:
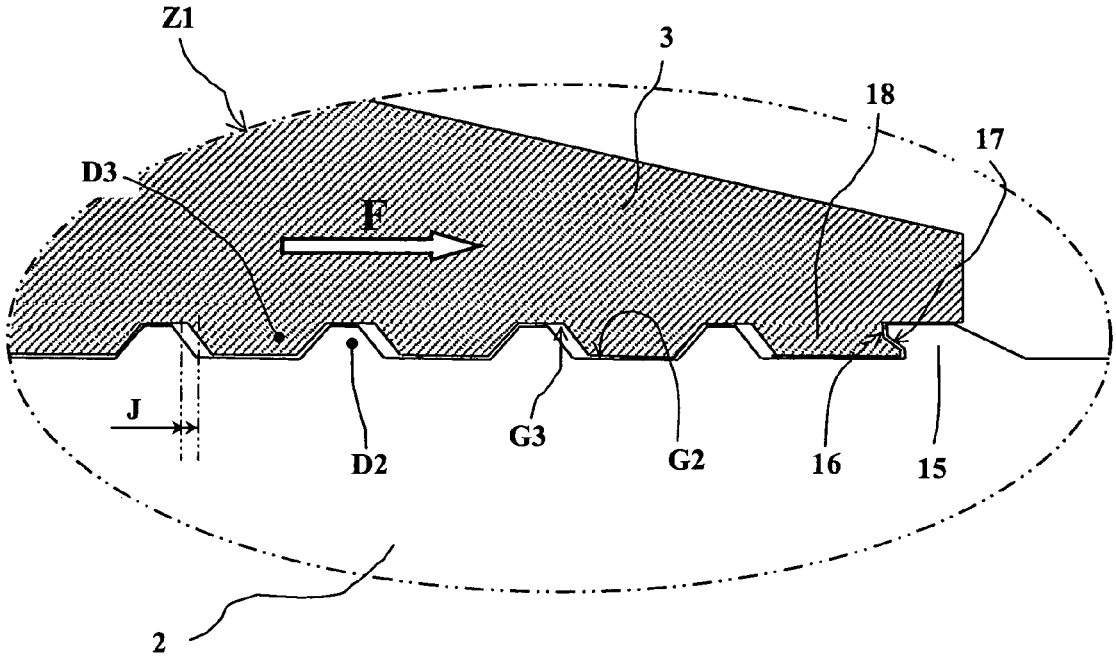
FIG. 5*a* shows an enlargement of another embodiment of a drive profile implemented on a projectile according to the invention, this Figure shows how the sabot profile cooperates with that of the penetrator when the projectile is being fired.
Figure 5B:
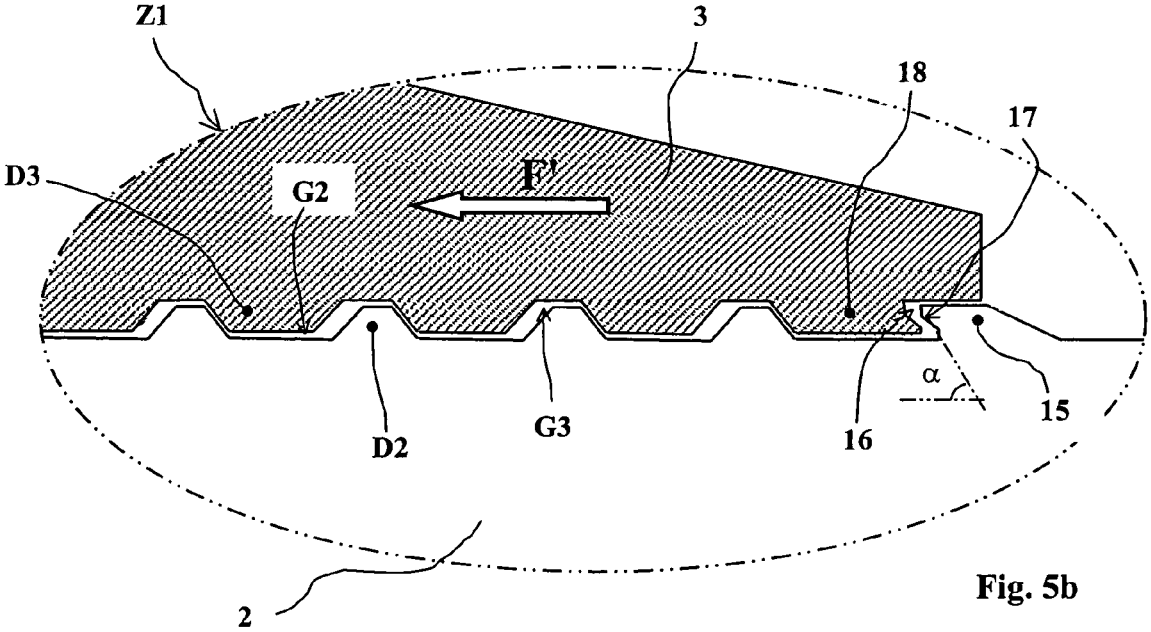
FIG. 5*b* shows how the sabot profile cooperates with that of the penetrator upon exiting the gun barrel.

FIGS. 5*a* and 5*b* show an enlargement of the zone Z1 of FIG. 1, such zone positioned at the front part of a projectile according to a third embodiment of the invention.

In this embodiment, teeth D2, D3 and grooves G2, G3 of the penetrator and sabot have a classical ISO profile analogous to that described previously with reference to FIG. 2*a* (but they could alternatively have an artillery profile such as those in FIG. 2*b*). The profile may be constituted either by threading or by a succession of ring-shaped teeth and grooves.

According to the invention, play J is provided that enables an axial displacement of the penetrator 2 with respect to the sabot 3.

According to this particular embodiment, a specific tooth 15 is located forward of the grooves G2 and teeth D2 of the penetrator 2. This tooth incorporates a concave conical profile on its rear face 16 which, during firing, cooperates with a convex conical profile 17 made on a front face of a tooth 18 on the sabot 3.

The half-angle at the tip α (FIG. 5*b*) of the conical surfaces of faces 16 and 17 will be chosen at around 70° to 85°.

This cooperation of the profiles with respect to tooth 15 provides radial locking for the sabot 3 segments with respect to the penetrator 2 during firing.

Functioning is analogous to that described above for the previous embodiments. During firing, the pressure exerted at the rear of the sabot 3 pushes it forwards. There is a relative displacement of the sabot with respect to the penetrator in direction F (FIG. 5*a*) and tooth 18 is locked by tooth 15.

Contrary to the previous embodiments, here only the front part of the sabot 3 is locked. It is therefore unable to remove itself from the penetrator during the cannon phase despite the effects of both acceleration and air pressure. The penetrator is well supported and premature wear of the guiding seats 6 further to the spreading of the sabot 3 segments is thus avoided.

Locking is ensured for as long as the gas pressure acts on the rear of the sabot, that is to say, for the full time the projectile is in the gun barrel.

Upon exiting the barrel, the pressure exerted upon the rear of the sabot suddenly drops. The sabot, pushed by the relative wind created by the flight of the projectile, is displaced backwards with respect to the penetrator in direction F' (FIG. 5*b*).

This displacement ensures the unlocking of the sabot penetrator link. The released sabot is able to separate from the penetrator following the usual opening mechanisms.

What is claimed is:

1. A sub-caliber projectile, comprising:

a penetrator and a sabot formed of several segments, said penetrator and sabot incorporating profiles that cooperate with one another to ensure an axial drive of said penetrator by said sabot when the sub-caliber projectile is being fired with a gun barrel, wherein there is axial play between the profile on said sabot and the profile on said penetrator to enable a limited relative axial displacement of said sabot with respect to said penetrator, means are provided to ensure radial locking of said sabot segments by said penetrator in a foremost position of said sabot with respect to said penetrator, the radial locking no longer being ensured in a rearmost position of said sabot with respect to said penetrator.

2. The sub-caliber projectile according to claim 1, wherein said profiles on said sabot and on said penetrator are formed of teeth separated by grooves, said teeth and grooves being ring-shaped or formed by helicoidal threading, a rear face of said teeth on said penetrator having a concave profile cooperating during firing with a convex profile made on a front face of said teeth on said sabot, said profiles constituting means to ensure the radial locking of said sabot segments with respect to said penetrator during firing.

3. The sub-caliber projectile according to claim 2, wherein said front face of said teeth on said penetrator has a sloped profile at an angle with respect to an axial direction of said penetrator in a direction in which the front face projects away from the penetrator in a direction moving from the foremost position of the penetrator to the rearmost position of the penetrator, arranged during firing at a distance from an oppositely sloped profile made on said rear face of said teeth on said sabot, said profiles being additionally in contact with one another upon exiting said gun barrel when said sabot recoils with respect to said penetrater, a resulting contact between the sloped profiles enabling said sabot segments to be separated from said penetrator.

4. The sub-caliber projectile according to claim 2, wherein said front face of the teeth on said penetrator has a concave profile arranged during firing at a distance from a convex profile made on said rear face of the teeth on said sabot, said profiles coming into contact with each other upon exiting said gun barrel when said sabot recoils with respect to said penetrator, the shape of said profiles being chosen to separate said sabot segments away from said penetrator by causing a starting movement of said segments substantially parallel to said penetrator.

5. The sub-caliber projectile according to claim 1, wherein said radial locking comprises a specific tooth located to the fore of said grooves or threading on said penetrator, the specific tooth incorporating a concave profile on a rear face of the specific tooth cooperating during firing with a convex profile made on said front face of one of said specific teeth on said sabot to ensure the radial locking of said sabot segments with respect to said penetrator during firing.

6. A sub-caliber penetrator intended to be incorporated into a projectile according to claim 5, wherein said penetrator incorporates an external profile incorporating teeth separated by grooves, said teeth and grooves being ring-shaped or formed by helicoidal threading, the specific tooth being positioned to the fore of said teeth or grooves of said penetrator, the specific tooth incorporating a concave profile at a rear face of said specific tooth.

7. A sabot intended to be incorporated into a projectile according to claim 5, wherein the sabot incorporates an internal profile intended to accommodate said penetrator incorporating teeth separated by grooves, said teeth and grooves being ring-shaped or formed by helicoidal threading, the front face of said teeth positioned the foremost incorporating a convex profile.

8. A sub-caliber penetrator intended to be incorporated into said projectile according to claim 1, wherein the penetrator incorporates an external profile incorporating teeth separated by grooves, said teeth and grooves being ring-shaped or formed by helicoidal threading, a rear face of the teeth having a concave profile.

9. The sub-caliber penetrator according to claim 8, wherein a front face of said teeth has a sloped profile at an angle with respect to an axial direction of said penetrator in a direction in which the front face projects away from the penetrator in a direction moving from the foremost position of the penetrator to the rearmost position of the penetrator.

10. The sub-caliber penetrator according to claim 8, wherein a front face of the teeth has a concave profile.

11. A sabot intended to be incorporated into said projectile according to claim 1, wherein the sabot incorporates an internal profile intended to accommodate said penetrator and incorporating teeth separated by grooves, said teeth and grooves being ring-shaped or formed by helicoidal threading, one front face of said teeth having a convex profile.

12. The sabot according to claim 11, wherein a rear face of said teeth has a concave profile.

13. The sabot according to claim 11, wherein a rear face of said teeth has a convex profile.

* * * * *